US010786086B2

(12) United States Patent
Feldotto

(10) Patent No.: US 10,786,086 B2
(45) Date of Patent: Sep. 29, 2020

(54) HEIGHT-ADJUSTABLE BED

(71) Applicant: HERMANN BOCK GMBH, Verl (DE)

(72) Inventor: Udo Feldotto, Verl (DE)

(73) Assignee: HERMANN BOCK GMBH, Verl (DE)

( * ) Notice: Subject to any disclaimer, the term of this patent is extended or adjusted under 35 U.S.C. 154(b) by 495 days.

(21) Appl. No.: 15/559,338

(22) PCT Filed: Mar. 4, 2016

(86) PCT No.: PCT/EP2016/054624

§ 371 (c)(1),
(2) Date: Sep. 18, 2017

(87) PCT Pub. No.: WO2016/146406

PCT Pub. Date: Sep. 22, 2016

(65) Prior Publication Data

US 2018/0110338 A1 Apr. 26, 2018

(30) Foreign Application Priority Data

Mar. 17, 2015 (DE) ..... 20 2015 101 357

(51) Int. Cl.
*A47C 19/04* (2006.01)
*A61G 7/012* (2006.01)
(Continued)

(52) U.S. Cl.
CPC ..... *A47C 19/045* (2013.01); *A61G 7/012* (2013.01); *A61G 7/0509* (2016.11); *A61G 7/053* (2013.01);
(Continued)

(58) Field of Classification Search
CPC .... A61G 7/0509; A61G 7/012; A61G 7/0516; A61G 7/053; A61G 7/0533; A61G 7/1019; A47C 19/045
See application file for complete search history.

(56) References Cited

U.S. PATENT DOCUMENTS 9,265,680 B2 * 2/2016 Sharps ..... A61G 13/04
9,636,266 B2 * 5/2017 Jackson ..... A61G 7/012
(Continued)

FOREIGN PATENT DOCUMENTS

DE 202012103958 U1 * 10/2012 ..... A61G 7/0509
EP 2364685 A2 9/2011
WO WO-03/070145 A1 8/2003

*Primary Examiner* — Robert G Santos
*Assistant Examiner* — Rahib T Zaman
(74) *Attorney, Agent, or Firm* — Harness, Dickey & Pierce, P.L.C.

(57) ABSTRACT

The disclosure relates to a height-adjustable bed, in particular a hospital and/or nursing bed, comprising a bed frame, two bed end pieces, which accommodate the bed frame between said bed end pieces, and two telescopic lifting columns, which each interact with one of the two bed end pieces and have a supporting segment and a moving segment, wherein the lifting columns are arranged on the associated bed end pieces on the outside of the bed by means of the supporting segments of the lifting columns, and wherein the moving segment of a lifting column has a lifting column base, on which a supporting roller that can rotate about the vertical axis thereof is arranged, wherein the distance between the articulation point of the supporting roller and the associated bed end piece exceeds the rotation radius that can be described by the supporting roller about the vertical axis thereof.

6 Claims, 9 Drawing Sheets

(51) Int. Cl.

| | |
|---|---|
| ***A61G 7/05*** | (2006.01) |
| *A61G 7/053* | (2006.01) |
| *A61G 7/10* | (2006.01) |

(52) U.S. Cl.
CPC ..... *A61G 7/0516* (2016.11); *A61G 7/0533* (2013.01); *A61G 7/1019* (2013.01)

(56) References Cited

U.S. PATENT DOCUMENTS

| | | | | |
|---|---|---|---|---|
| 9,642,760 | B2 * | 5/2017 | Jackson | A61G 13/04 |
| 9,744,087 | B2 * | 8/2017 | Jackson | A61G 7/015 |
| 2005/0172403 | A1 * | 8/2005 | Darling | A47C 19/045 5/509.1 |
| 2006/0185090 | A1 * | 8/2006 | Jackson | A61G 13/0036 5/621 |
| 2007/0192960 | A1 * | 8/2007 | Jackson | A61G 7/001 5/618 |
| 2010/0223728 | A1 * | 9/2010 | Hutchison | A61G 7/012 5/610 |
| 2013/0015300 | A1 * | 1/2013 | Klinke | A47B 9/20 248/49 |
| 2013/0019410 | A1 * | 1/2013 | Willis | A47C 31/00 5/663 |
| 2013/0111666 | A1 * | 5/2013 | Jackson | A61G 13/0036 5/601 |
| 2017/0281441 | A1 * | 10/2017 | Fich | A61G 7/08 |
| 2018/0110338 | A1 * | 4/2018 | Feldotto | A47C 19/045 |

* cited by examiner

HEIGHT-ADJUSTABLE BED

CROSS-REFERENCE TO RELATED APPLICATIONS

This application is a National Stage of International Application No. PCT/EP2016/054624, filed on Mar. 4, 2016 and claims priority to German Patent Application No. 20 2015 101 357.4, filed on Mar. 17, 2015. The entire disclosures of the above applications are incorporated herein by reference.

FIELD

The invention concerns a height-adjustable bed, in particular a hospital bed and/or nursing bed, comprising a bed frame and two bed end pieces, which accommodate the bed frame between them, and two telescopic lifting columns, each of which interacts with one of the two bed end pieces and is provided with a supporting segment and a moving segment, wherein the lifting columns are each arranged on their corresponding bed end piece on the outside of the bed by means of their respective supporting segments, and wherein the moving segment of a lifting column has a lifting column base to which a supporting roller is pivotally attached and able to rotate about its vertical axis.

BACKGROUND

This section provides background information related to the present disclosure which is not necessarily prior art.

A height-adjustable bed of the kind described at the outset, that is, of the generic kind, is known from DE 20 2012 103 958 U1.

The known bed comprises a bed frame that serves to accommodate a support surface element, for example a slatted base, wherein the support surface element in turn is provided, according to its intended use, to support a mattress, a pillow element and/or such like. The bed frame extends between two bed end pieces that accommodate the bed frame between them. The bed end pieces typically comprise each an end board, which is screwed or otherwise fastened to the rails of the bed frame.

The known bed is devised to be height-adjustable. To this end two lifting columns are provided that are telescopic, each of which is provided with a supporting segment and a moving segment. Each of the lifting columns interacts with the respective bed end piece, wherein the one lifting column is arranged at the first bed end piece and the second lifting column is arranged at the second bed end piece.

According to the prior known design, each of the lifting columns is arranged on the respective bed end piece. In contrast to a height adjusting device that is located underneath the bed frame, this has the advantage of a relatively wide movement range. Moreover, the prior known design provides for a low bed entry height at the lowest bed level setting, which for the generic bed design is approximately 200 mm.

To facilitate moving the bed, the prior known bed is provided with supporting rollers. Said rollers are arranged on the lifting column base of each lifting column, wherein the lifting column base is supported by the moving segment of the lifting column. For better manoeuvrability each of the supporting rollers is able to rotate around its vertical axis. This provides for a relatively small turning circle, in particular when manoeuvring the bed, which is required for its intended use in the hospital and/or nursing sector.

Although the above-described design is tried and tested in everyday use, there is still room for improvement. In particular, it would be desirable to achieve an even lower bed entry height.

SUMMARY

This section provides a general summary of the disclosure, and is not a comprehensive disclosure of its full scope or all of its features.

Thus it is the object of the disclosure to further develop a bed of the kind described at the outset in such a way that, in comparison, it has an even lower bed entry height, that is, a bed entry height of less than 200 mm, whilst providing the same unrestricted functionality.

To meet this object, the disclosure proposes a bed of the kind described at the outset, which is characterised in that the distance between the pivot point of the supporting roller and the respective bed end piece exceeds the rotational radius described by the supporting roller around its vertical axis.

The design according to the disclosure is characterised by providing the distance between the pivot point of each supporting roller and the respective bed end piece. The distance between the pivot point and the bed end piece is at least that of the rotational radius describable by the supporting roller.

Through this design measure according to the invention it is ensured that each supporting roller is able to freely rotate around its vertical axis without colliding with the respective bed end piece when the supporting rollers rotate. As a result of this design it is therefore possible to lower the bed frame together with the thereto attached bed end pieces down to floor level. Due to the distance provided, the supporting rollers are freely rotatable around 360° and are not impeded by a bed frame that is perhaps lowered to floor level or by any bed end pieces that are attached thereto.

This constructive layout, moreover, ensures that, when lowering the bed frame, no collision is possible between the thereon arranged bed end pieces and a supporting roller that may still be underneath the bed frame. The distance provided according to the invention ensures that no supporting roller is able to turn in underneath the bed frame or under the bed end piece respectively attached thereto. Due to the distance provided according to the invention, the bed frame and the bed end pieces arranged thereto and the supporting rollers respectively are arranged to each other in their respective movement range so as to be collision-free.

The collision-free arrangement of bed frame and the bed end pieces attached thereto and the supporting rollers on the other hand permit the movement of the bed frame together with the bed end pieces attached thereto down to floor level. Depending on the height of the bed frame it is possible to achieve a bed entry height of less than 200 mm, preferably of less than 150 mm, even more preferred less than 100 mm. Thus the design according to the invention constitutes a significant improvement compared to the design known per se from DE 20 2012 103 958 U1.

According to a particularly preferred embodiment according to the invention, provision is made that the lifting column base is provided with a base rail and two support rails that are attached at the ends thereof, each of which retains a supporting roller, wherein each support rail is oriented away from the respective bed end piece by an angle ? [sic]. Thus, the support rails that retain the supporting rollers are each offset so that they are directed away from the respective head board. Said offset design of the support rails provides the distance provided according to the invention. Said supporting rollers are arranged preferably at the end of each support rail, wherein the length of each support rail and the offset angle are matched to each other in such a way that the end section of each support rail, which retains the supporting roller, is at such a distance from the corresponding bed end piece that, as described earlier, a collision-free rotational movement of the supporting roller or the travel movement respectively of the bed frame including the attached bed end pieces is permitted.

The support rails are not only offset in a direction pointing away from the bed end piece, they are also offset at an angle pointing upwards, starting from the base rail, which facilitates the maximum movement of the bed frame together with the attached bed end pieces in vertical direction downwards.

According to a further characteristic of the invention, each supporting roller is provided with a cap element that is disposed in vertical direction above the respective supporting roller. Said cap element serves as wall guard or edge protector respectively. The collision-free location of the supporting roller in accordance with the design according to the invention means that the supporting rollers protrude beyond the external boundaries of the bed frame or the bed end pieces disposed thereon respectively. During manoeuvring of the bed it can occur that the supporting rollers collide with walls, furniture and/or such like. To provide contact protection in this respect, the above-described cap element is proposed with the disclosure. Said cap element is disposed in vertical direction above the respective supporting roller and has a radius that is greater than the rotational radius of the respective supporting roller. This ensures that, in the instance of a collision, the cap element is impacted and not the supporting roller. Accordingly, the cap element is made from a preferably soft, elastic material that does not stain when exposed to friction. Moreover, it is preferable that the cap element is designed to be rotatable around its vertical axis so that, if contact is made, the cap element can roll off the contact object, for example the building wall and/or such like.

According to a further characteristic of the disclosure it is proposed that the supporting segment provides a hollow column, the lower edge of which in vertical direction is disposed above the lower edge of the respective bed end piece in vertical direction. Thus the lower edges of the supporting segment and of the bed end piece do not finish flush with each other. Rather, the bed end piece extends beyond the supporting segment in the lower section, which advantageously creates a free space between the lower edge of the supporting segment in vertical direction on the one hand and the lower edge of the bed end piece in vertical direction on the other hand. In a lowering movement downwards, said free space serves to provide a receiving space for the lower part of the moving segment of the lifting column as well as for the base rail of the lifting column base that is supported by the moving segment. In a lowering movement of the bed downwards, the base rail in particular can enter into said free space, which provides for a maximum movement range of the bed in downward direction.

The column is provided with a cover at its top edge, which finishes, preferably at least in sections, flush with the in vertical direction upper edge of the associated bed end piece.

According to a further characteristic of the disclosure, the support segment is provided on the outside with two vertically extending grooves that face each other. Said grooves are provided to accept functional elements, in particular sheet-like decorative elements. Said decorative elements may be inserted with their respective edges into the corresponding grooves which, when installation is complete, are then positively locked in the grooves. The grooves are also closed at the top end through the cover, which ensures the secure retention of the sheet-like decorative element on the supporting segment.

Moreover, a lifting column with the above-described characteristics is proposed with the disclosure. A lifting column of this kind provides the also already described advantages.

DRAWINGS

The drawings described herein are for illustrative purposes only of selected embodiments and not all possible implementations, and are not intended to limit the scope of the present disclosure.

Further characteristics and advantages of the disclosure are apparent from the following description based upon the Figures. The figures illustrate:

DETAILED DESCRIPTION

Figure 1:
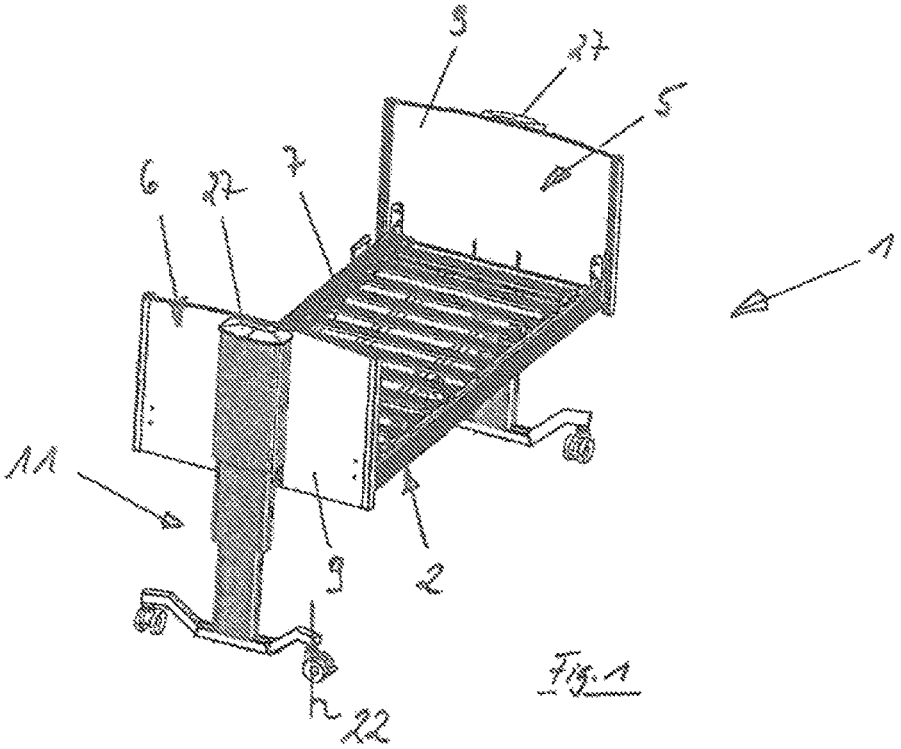
FIG. 1 shows a schematic perspective view of a bed according to the disclosure in a first position.
Figure 2:
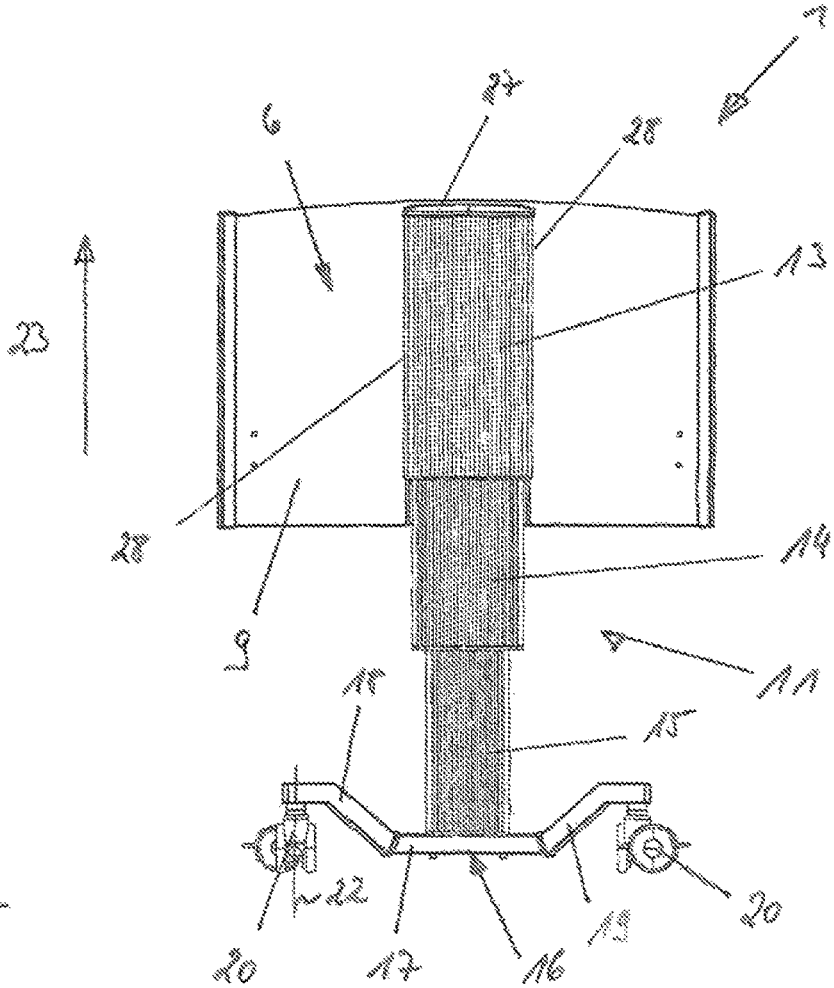
FIG. 2 shows the bed according to FIG. 1 in front elevation.
Figure 3:
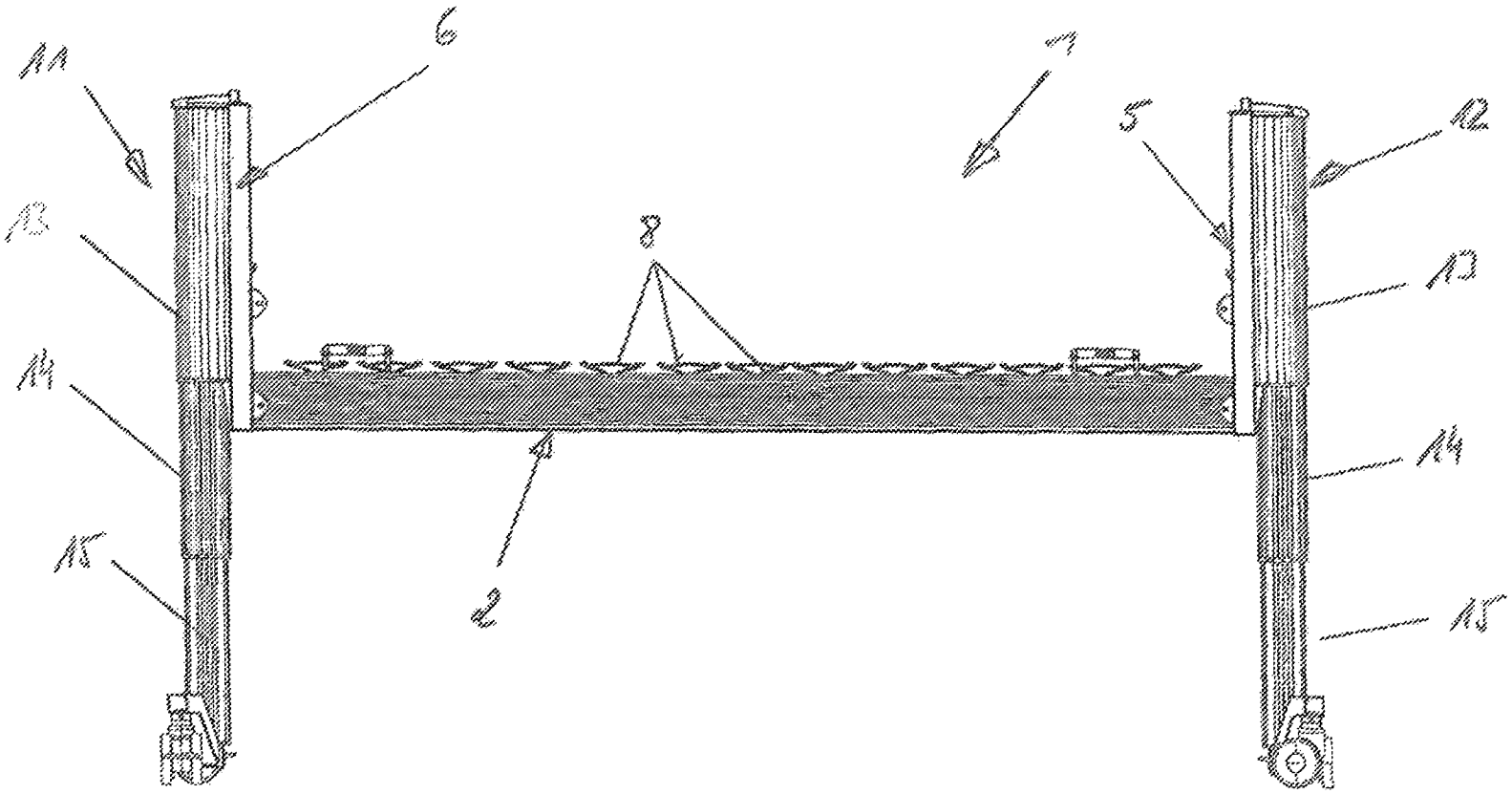
FIG. 3 shows the bed according to FIG. 1 in lateral elevation.
Figure 4:
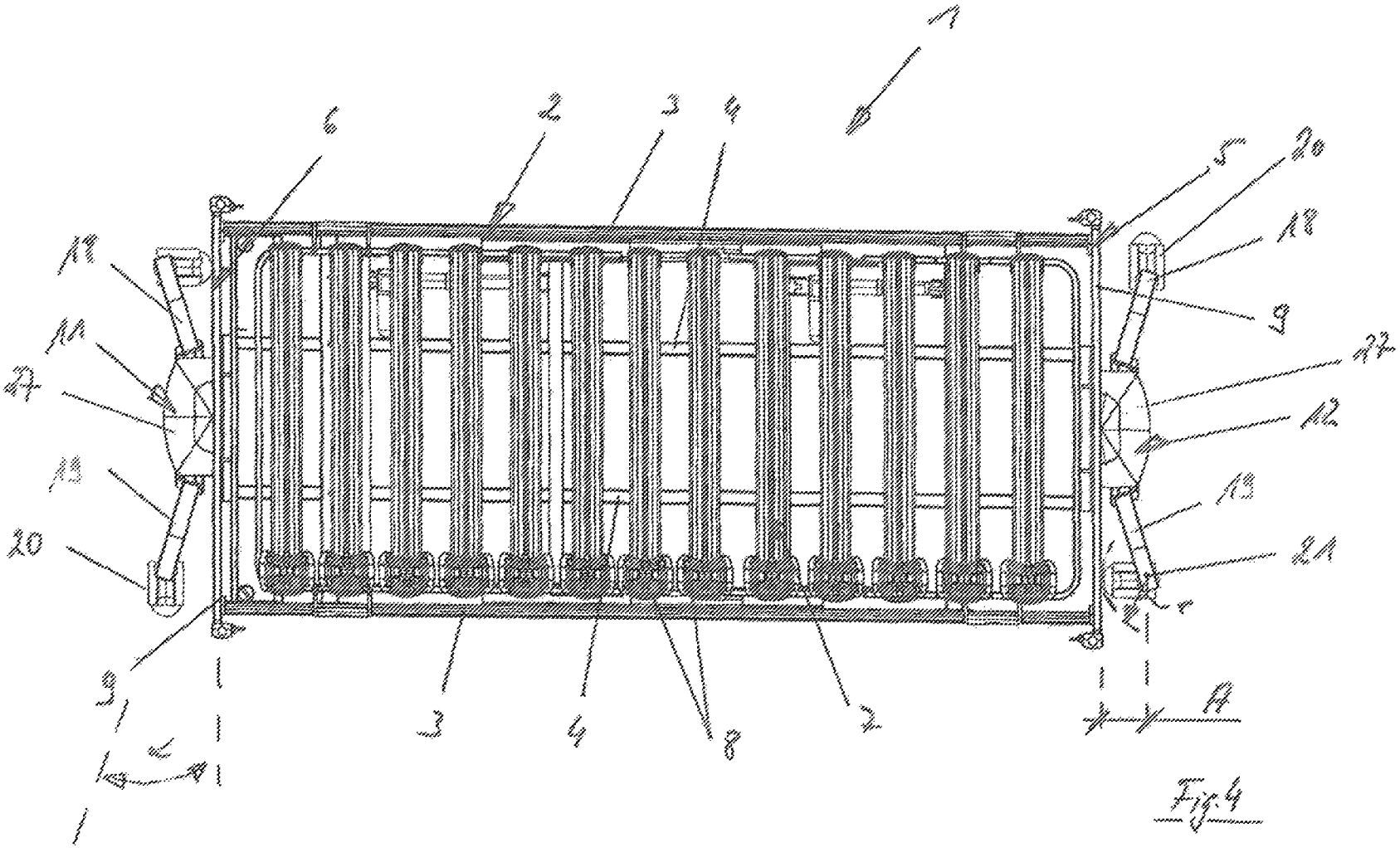
FIG. 4 shows the bed according to FIG. 1 in top plan view.
Figure 5:
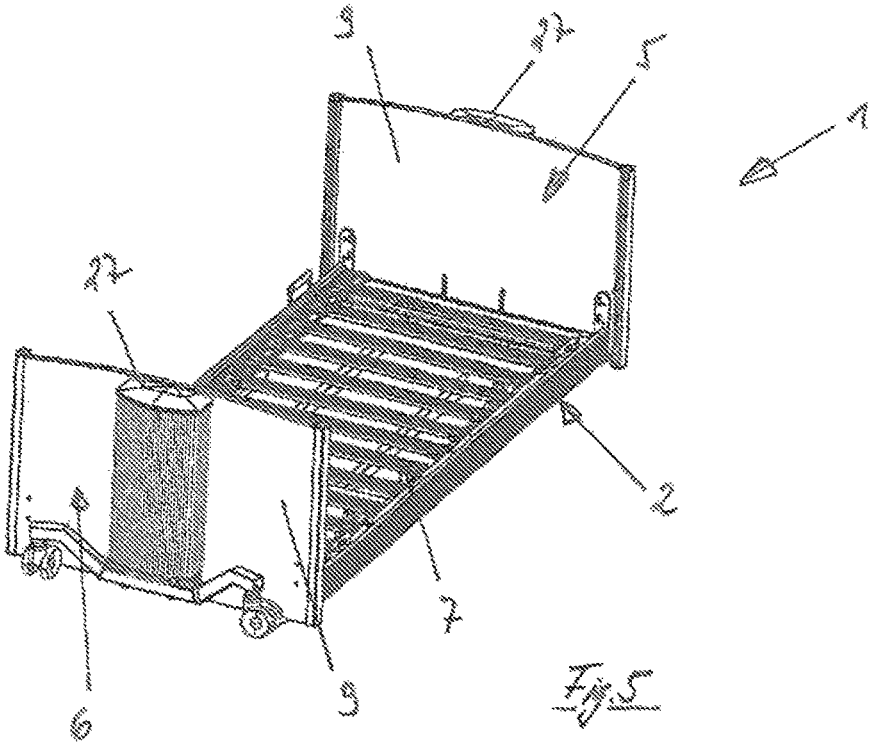
FIG. 5 shows schematic perspective view of a bed according to the disclosure in a second position.

Example embodiments will now be described more fully with reference to the accompanying drawings.

Each of the FIGS. 1 to 12 depicts the bed 1 according to the disclosure, wherein the FIGS. 1 to 4 show the bed 1 from various sides in a first position, the FIGS. 5 to 8 show the bed 1 from various sides in a second position, and the FIGS. 9 to 12 show the bed 1 from various sides in a third position.

An overview of the Figures makes it apparent that the bed 1 according to the disclosure comprises a bed frame 2. Said bed frame 2 is disposed between two bed end pieces 5 and 6, that is, between the head end 5 on the one hand and the foot end 6 on the other hand. When used as intended, the bed frame 2 serves to support a support surface element 7. In the exemplary embodiment shown, the support surface element 7 is provided in form of a slatted base and is comprised of a plurality of sections 10 that are pivotable relative to each other, which is depicted clearly in particular in an overview of FIGS. 9 to 12.

The bed frame 2 in the exemplary embodiment shown is comprised of two outer frame rails 3 as well as two inner frame rails 7. They are attached, preferable screwed, at the end to the respective bed ends 5 and 6.

Each bed end piece 5 and 6 respectively provides an end board 9, which may, for example, be made from timber or plastic, or a compound material.

To provide support for a bed mattress on the support surface element 7 in an intended use application, the support surface element 7 is provided with spring elements 8, wherein each slat of the support surface element 7 is provided with a plurality of spring elements 8 that are disposed at a certain distance from each other. A number of said spring elements 8 are shown in the Figures as an example.

The bed 1 is made to be height-adjustable. To facilitate this, the bed 1 is provided with lifting columns 11 and 12. These are disposed on each of the bed end pieces, and provision is made so that the lifting columns 11 and 12 are located on the outside of the bed. In the exemplary embodiment shown, the foot end 6 supports the lifting column 11 and the head end 5 the lifting column 12.

Both lifting columns 11 and 12 are telescopic and comprise a supporting segment 13, a centre segment 14 and a moving segment 15. The moving segment 15 is formed relative to the centre segment 14, and the centre segment 14 is formed relative to the supporting segment 13.

The FIGS. 1 to 4 depict the bed 1 with extended lifting columns 11 and 12. The lifting columns 11 and 12 are extended to their maximum in this position of bed 1.

The moving segment 15 of each lifting column 11 and 12 respectively comprises a lifting column base 16. In the exemplary embodiment shown, said lifting column base 16 is provided with a base rail 17, and attached to its ends are the support rails 18 and 19. As is apparent from FIG. 2 in particular, said support rails 18 and 19 extend at an angle in upward direction 23, starting from the base rail 17. As is particularly apparent in the plan view according to FIG. 4, the support rails 18 and 19 are offset relative to the respective bed end piece at an angle ? [sic], in a direction opposite to the respective bed end piece 5 or 6 respectively.

Each of the support rails 18 and 19 supports the thereto attached supporting rollers 20, wherein the supporting rollers 20 are rotatably attached to the associated support rail 18 and 19 respectively, pivoting around their vertical axis. The distance A between the pivot point 21 of a supporting roller 20 and the respective bed end piece 5 or 6 exceeds the rotational radius r that is described by the supporting roller 20 around its vertical axis 22, which is particularly apparent from the depiction in FIG. 4.

Due to the offset arrangement of the support rails 18 and 19, a collision-free movement of the bed frame together with the thereon attached bed end pieces 5 and 6 into a lower position is possible, as depicted in FIGS. 5 to 8. As shown in particular in FIGS. 6 and 7, the bed frame 2 together with its bed end pieces 5 and 6 is able to move past the supporting rollers 20 of each lifting column 11 and 12 respectively collision-free, so that the bed frame 2 with its bed end pieces 5 and 6 disposed thereon is able to move downwards until it rests on the floor. The rollers, which are rotatable around their respective vertical axis 22, do not reach underneath the bed frame 2, nor under the bed end pieces 5 and 6 disposed thereon, and thus do not present an obstacle to a downwards movement.

Figure 6:
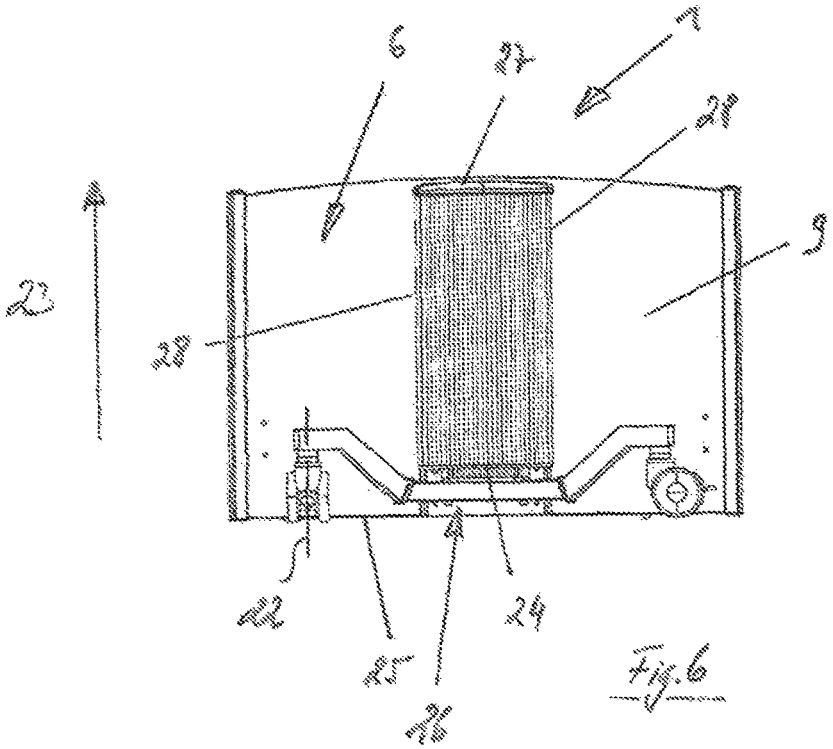
FIG. 6 shows the bed according to FIG. 5 in front elevation.
Figure 7:
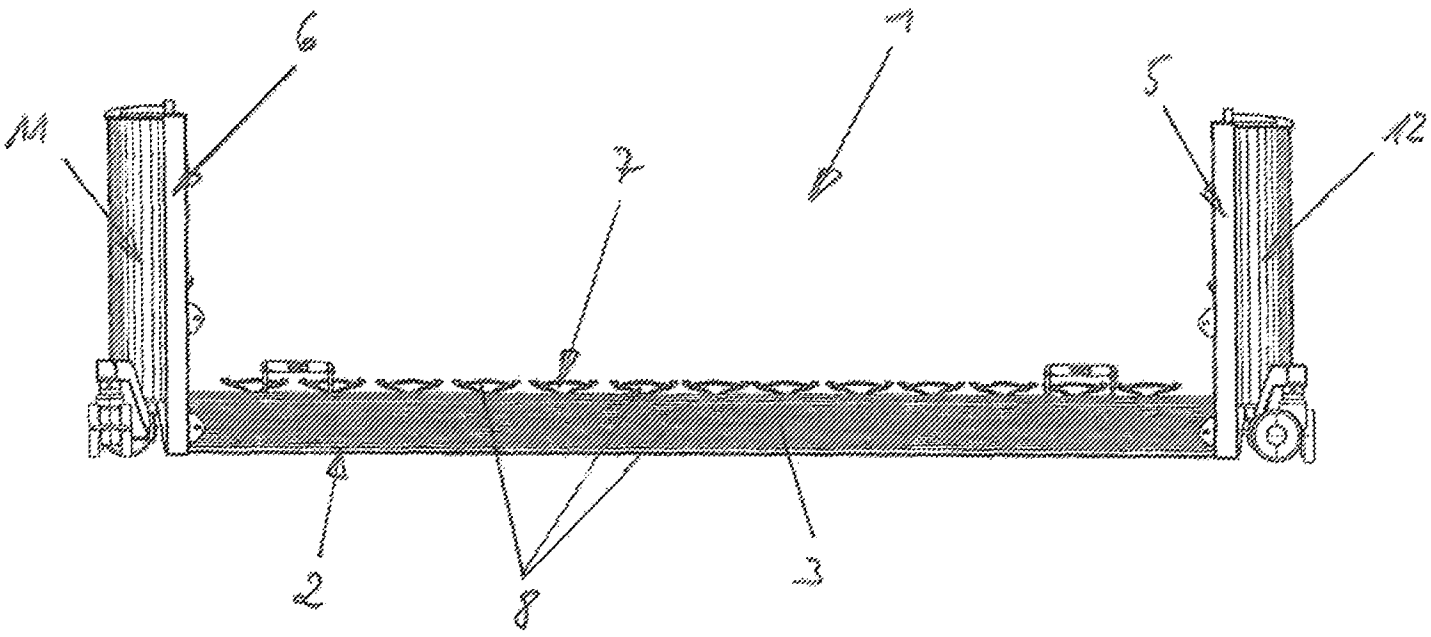
FIG. 7 shows the bed according to FIG. 5 in lateral elevation.
Figure 8:
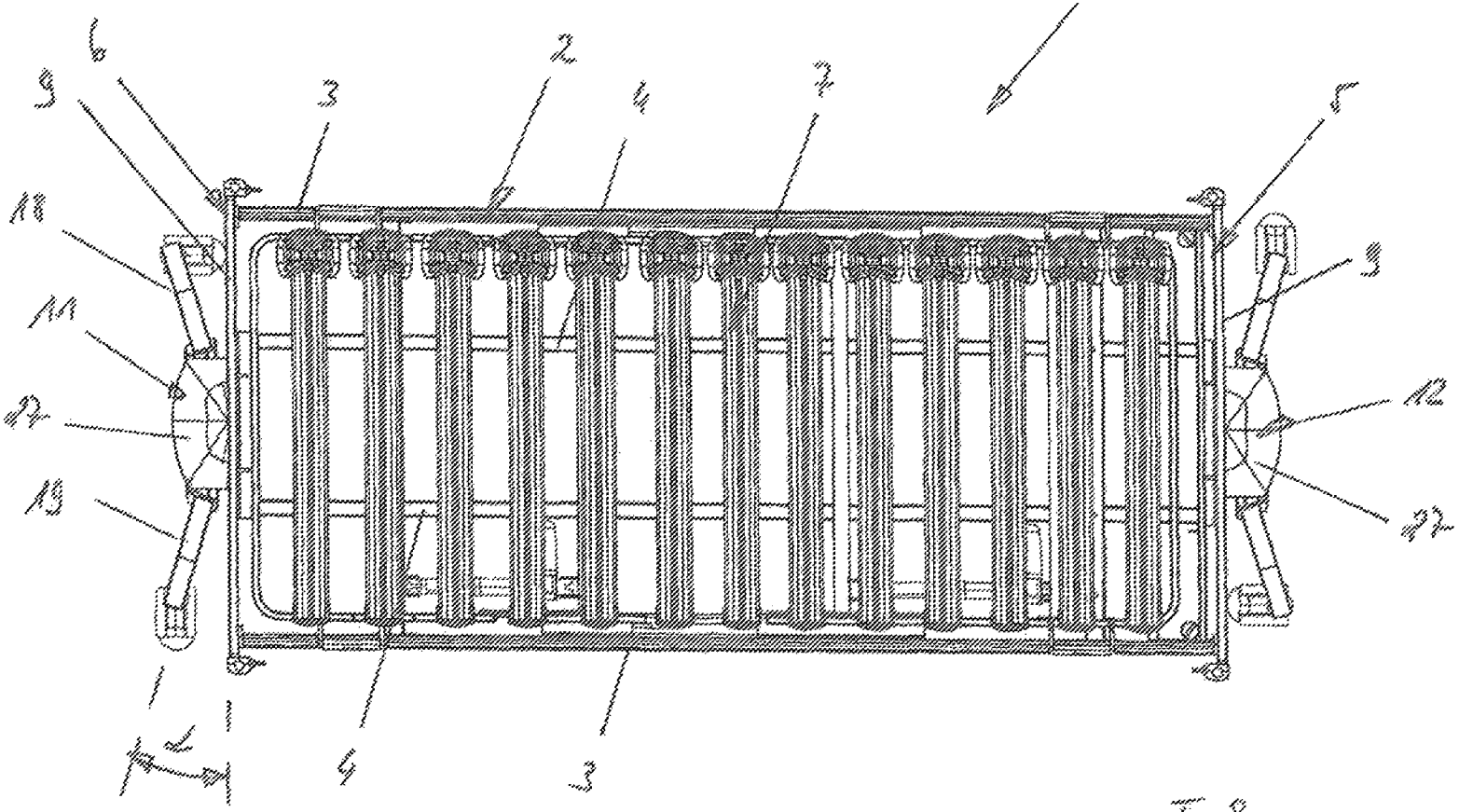
FIG. 8 shows the bed according to FIG. 5 in top plan view.
Figure 9:
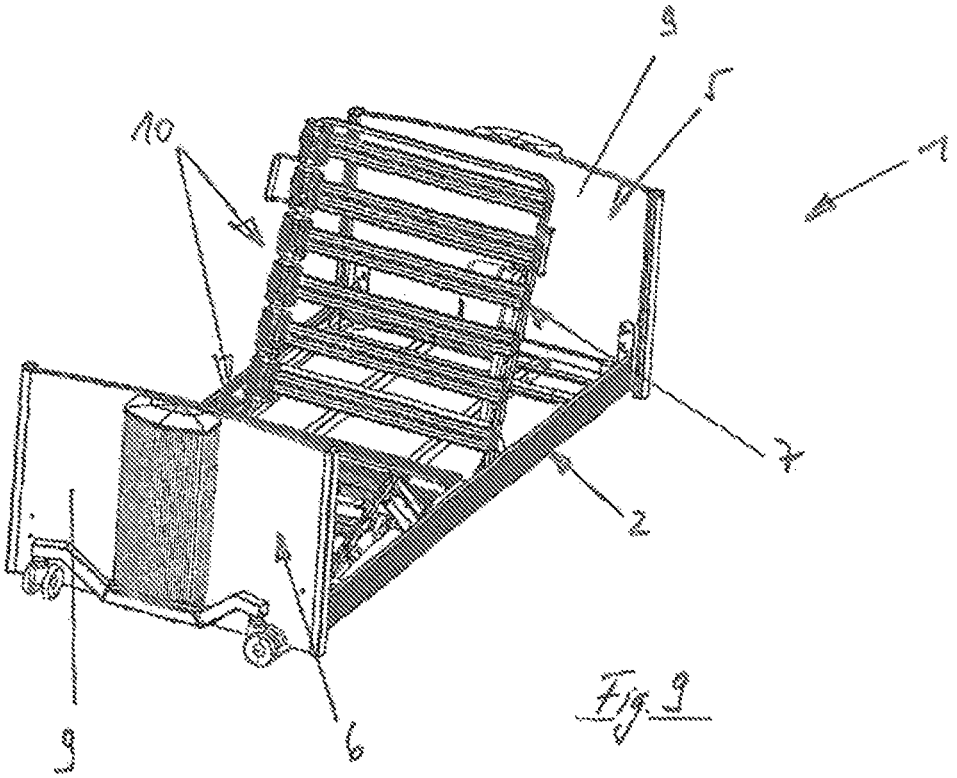
FIG. 9 shows a schematic perspective view of a bed according to the disclosure in a third position.
Figure 10:
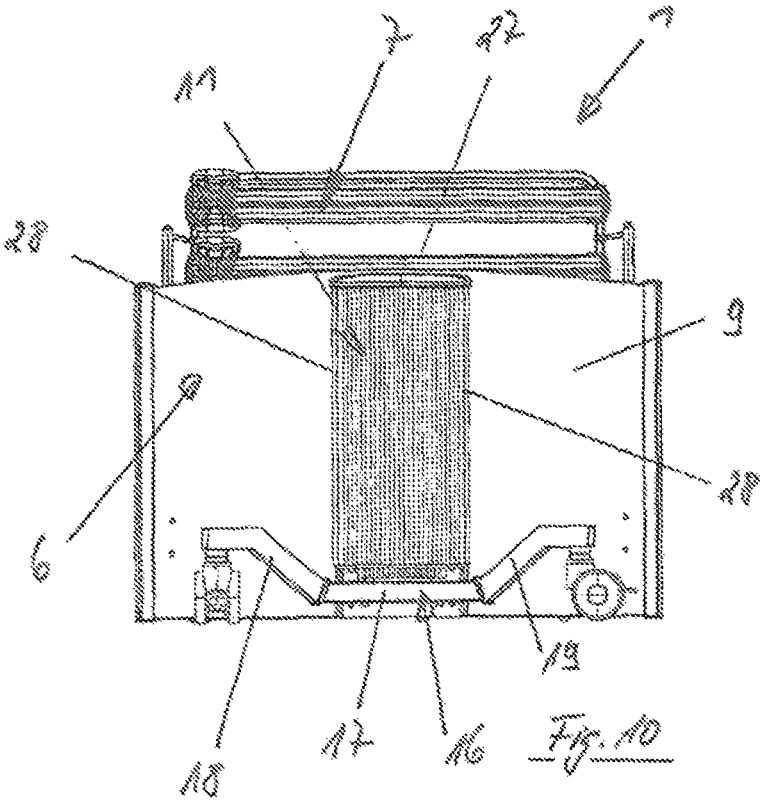
FIG. 10 shows the bed according to FIG. 9 in front elevation.
Figure 11:
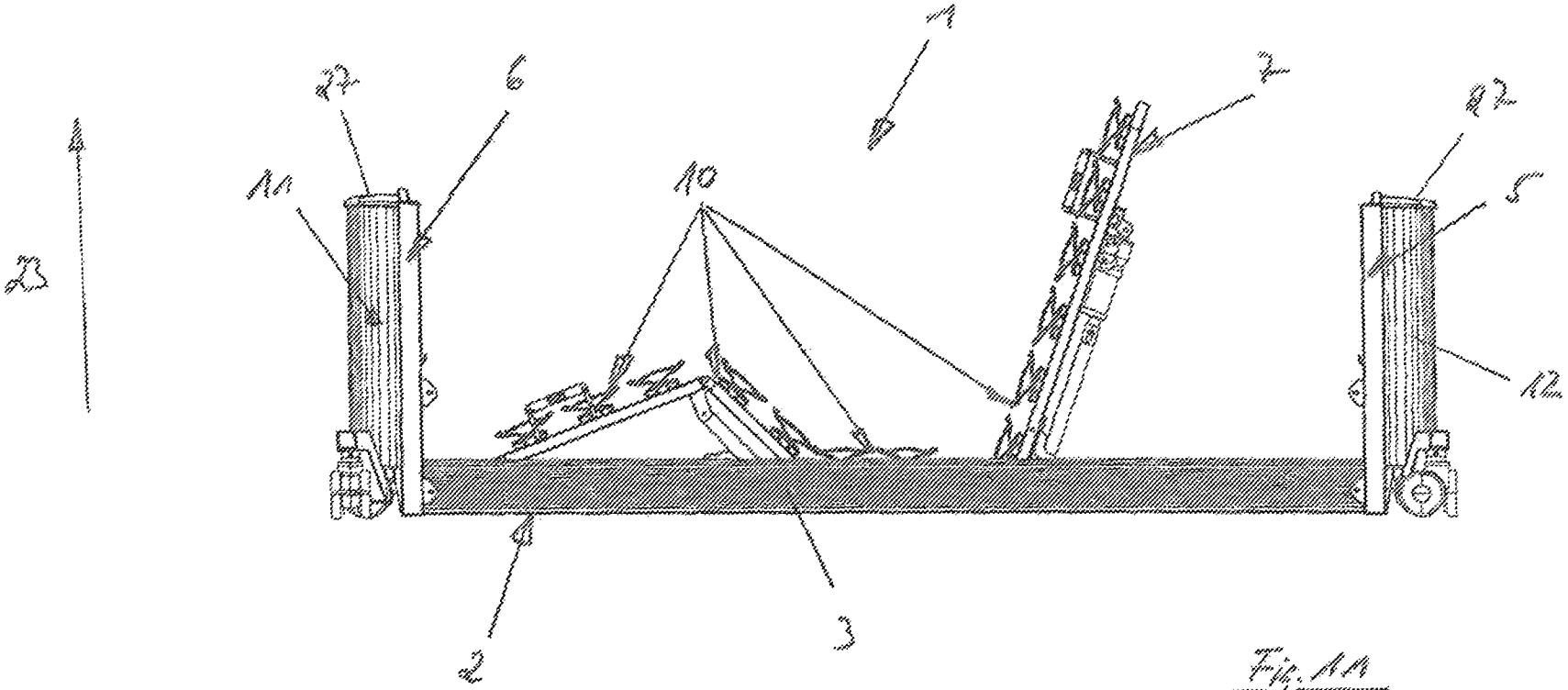
FIG. 11 shows the bed according to FIG. 9 in lateral elevation.
Figure 12:
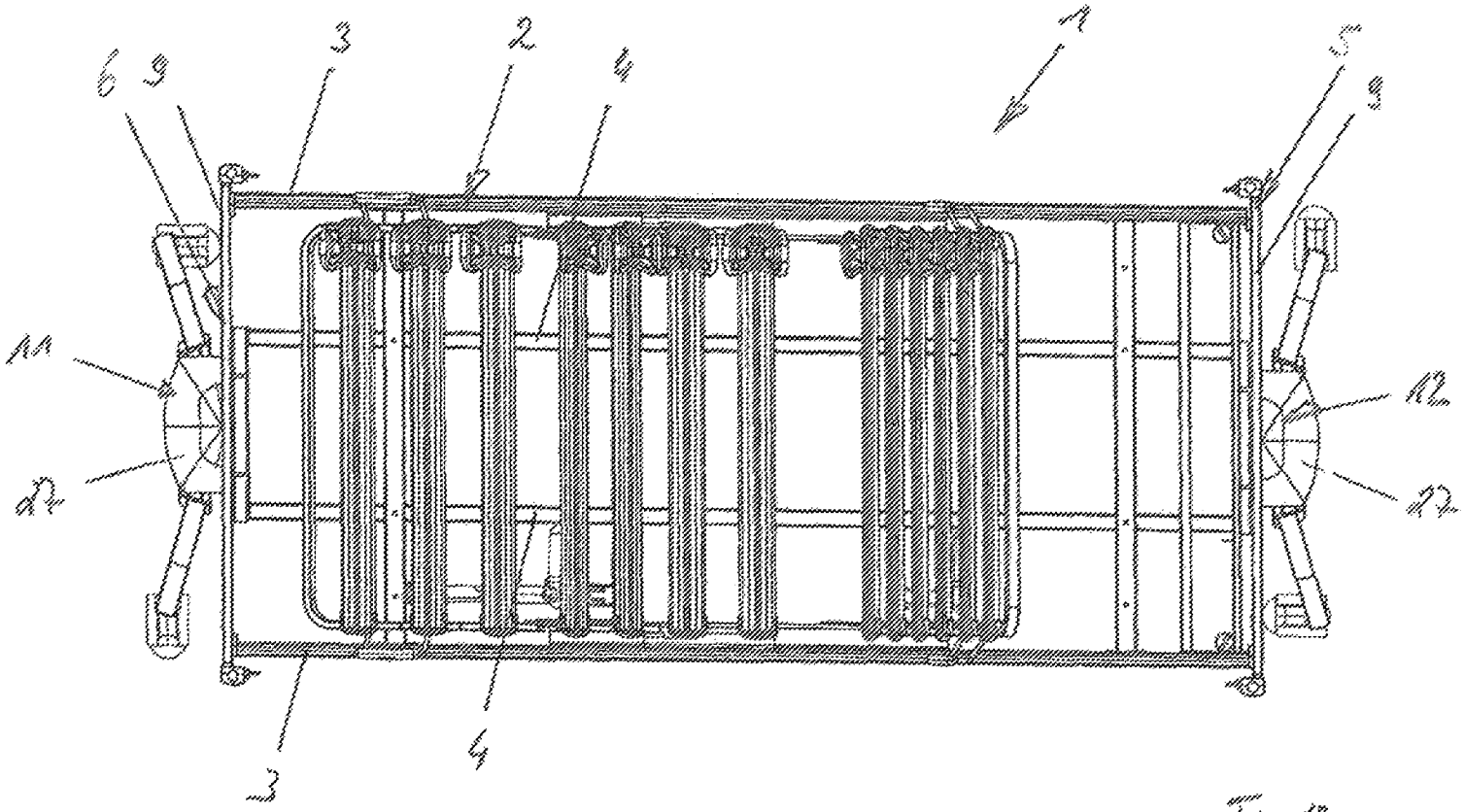
FIG. 12 shows the bed according to FIG. 9 in top plan view.

As is particularly apparent from the depictions according to FIGS. 6 and 7, the lower edge 24 of the supporting segments 13 of the lifting columns 11 and 12 respectively finishes in vertical direction 23 above the lower edge 25 of the end board 9 of the respective bed end piece 5 or 6 respectively.

This creates a free space 26 between the lower edges 24 and 25 into which the respective lifting column base 16 with its base rail 17 can enter when the bed 1 is lowered.

The supporting segment 13 of each lifting column 11 and 12 respectively is provided on its side that faces away from the bed end piece with grooves 28 that extend in vertical direction 23 and are located on the edge of every supporting segment 13. The grooves 28 are facing each other with their open side and serve, in the application as intended, the purpose of receiving the edge of a decorative element in form of decorative board that is supported by the supporting segment 13. Said decorative board may be inserted in longitudinal direction of the grooves 28 and serves in particular to improve the aesthetic appearance of the supporting segment 13. Nevertheless, other functional elements may also be inserted into the grooves 28 instead of the decorative board.

In the final assembled state the supporting segment 13 of each lifting column 11 and 12 respectively is covered at the top with a lid 27. Said lid 27 also serves to close off the grooves 28 so that a functional element retained therein cannot accidently fall out or be removed from it.

According to a further characteristic of the disclosure, the bed frame 2 of bed 1 is provided with frame rails 3 and 4 that can be extended in longitudinal bed direction. To facilitate this, said frame rails 3 and 4 respectively may be made telescopic, or may in other ways be provided in two sections that are moveable relative to each other in longitudinal bed direction. Due to this design it is possible to extend bed 1 if necessary by pulling it out. In the retracted state of the frame rails, the bed end pieces have a standard distance of preferably 2 m. This allows for the placement of a standard mattress on the support surface element 7. If required the bed 1 can be extended in longitudinal bed direction through pulling the frame rails 3 and 4 apart to an internal dimension between the bed end pieces 5 and 6 of 2.20 m. Thus the frame rails 3 and 4 enable an increase in distance between both end pieces 5 and 6 of 20 cm.

To ensure that, when extending the bed or returning the bed 1 to its standard dimension, the frame rails 3 and 4, that is, their respective sections to each other, are not inadvertently twisted, a gear arrangement is provided according to a further aspect of the disclosure, by means of which the second sections of the frame rails 3 and 4 are coupled in their movement in longitudinal bed direction. Thus, due to the gear arrangement the extendable frame rails 3 and 4 are synchronised, which ensures that, independent from the force applied to the bed end pieces 5 and 6, always the same travel movement of the frame rails 3 and 4 is ensured. The synchronisation through the gear arrangement thus ensures that the frame rails 3 and 4 are retracted or extended equally. The problem of a possible twisting is therefore completely eliminated.

The gear arrangement has a further advantage. It may be used to transmit a force into the bed frame 2 for extending or retracting the bed. In this respect it is not necessary for the user to grab and move the bed end pieces 5 and 6 in order to extend or retract it. Particularly preferred in this regard is to provide an electrical drive for the gear arrangement. This permits the user to extend or retract the bed as required by the push of a button. This increases the ease of operation significantly. In particular it is not necessary to have two persons available to extend or shorten the bed to the required length. Due to the gear arrangement only a single person is required to extend or shorten the bed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A height-adjustable bed, in particular a hospital bed and/or nursing bed, comprising a bed frame and two bed end pieces, which accommodate the bed frame between them, and two telescopic lifting columns, each of which interacts with one of the two bed end pieces and is provided with a supporting segment and a moving segment, wherein the lifting columns are each arranged on their corresponding bed end piece on the outside of the bed by means of their respective supporting segment, and wherein the moving segment of the respective lifting column has a lifting column base at which two supporting rollers are pivotally attached so as to be rotatable about respective vertical axes, wherein a distance between a pivot point of each of the supporting rollers and the associated bed end piece exceeds the rotational radius that the supporting roller describes when rotating about its vertical axis, wherein the lifting column base is provided with a base rail and two support rails attached at the ends thereof, the support rails each retaining one of said supporting rollers, wherein each support rail points away from the respective bed end piece by an angle.

2. The bed according to claim 1, wherein the supporting segment provides a hollow column whose lower edge in vertical extension is disposed above the lower edge in vertical direction of the respective bed end piece.

3. The bed according to claim 1, wherein the support segment has on the outside two grooves that mutually face each other and extend in vertical direction.

4. The bed according to claim 1, wherein the support segment supports an end cover.

5. A height-adjustable bed, in particular a hospital bed and/or nursing bed, comprising a bed frame and two bed end pieces, which accommodate the bed frame between them, and two telescopic lifting columns, each of which interacts with one of the two bed end pieces and is provided with a supporting segment and a moving segment, wherein the lifting columns are each arranged on their corresponding bed end piece on the outside of the bed by means of their respective supporting segment, and wherein the moving segment of the respective lifting column has a lifting column base at which two supporting rollers are pivotally attached so as to be rotatable about their respective vertical axes, wherein a distance between a pivot point of one of the supporting rollers and the associated bed end piece exceeds the rotational radius that the supporting roller describes when rotating about its vertical axis, the lifting column base being provided with a base rail and two support rails attached at the ends thereof, the support rails each retaining one of said supporting rollers, wherein each support rail points away from the respective bed end piece by an angle, the supporting rollers being arranged in a longitudinal direction of the bed frame behind the respective bed end pieces such that the supporting rollers do not project laterally beyond the bed frame.

6. The bed according to claim 5, wherein the bed frame is attached to the bed end pieces, the bed frame and the bed end pieces being movable together down to a floor level.

* * * * *